US010625520B2

(12) United States Patent
Nakano

(10) Patent No.: US 10,625,520 B2
(45) Date of Patent: Apr. 21, 2020

(54) PRINTING APPARATUS

(71) Applicant: SEIKO EPSON CORPORATION, Tokyo (JP)

(72) Inventor: Shuichiro Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/274,619

(22) Filed: Feb. 13, 2019

(65) Prior Publication Data

US 2019/0176486 A1 Jun. 13, 2019

Related U.S. Application Data

(63) Continuation of application No. 15/416,808, filed on Jan. 26, 2017, now Pat. No. 10,245,851.

(30) Foreign Application Priority Data

Jan. 29, 2016 (JP) ..... 2016-015312

(51) Int. Cl.

| | |
|---|---|
| ***B41J 11/00*** | (2006.01) |
| ***B41M 7/00*** | (2006.01) |
| *B41J 2/42* | (2006.01) |
| *G03G 13/20* | (2006.01) |

(52) U.S. Cl.

CPC ..... *B41J 11/002* (2013.01); *B41M 7/00* (2013.01); *B41J 2/42* (2013.01); *G03G 13/20* (2013.01)

(58) Field of Classification Search

CPC . B41J 11/002; B41J 2/42; B41M 7/00; G03G 13/20

See application file for complete search history.

(56) References Cited

U.S. PATENT DOCUMENTS

| | | | | |
|---|---|---|---|---|
| 5,337,393 | A * | 8/1994 | Reunamaki | C03B 29/08 219/388 |
| 7,025,831 | B1 | 4/2006 | Butterbaugh | |
| 2001/0002668 | A1 | 6/2001 | Gat | |
| 2009/0244147 | A1 | 10/2009 | Ohtsu | |
| 2011/0222925 | A1 | 9/2011 | Yokoyama | |
| 2012/0206527 | A1 * | 8/2012 | Leighton | B41J 2/17593 347/16 |
| 2015/0336398 | A1 | 11/2015 | Bucks | |
| 2017/0217211 | A1 | 8/2017 | Nakano | |

FOREIGN PATENT DOCUMENTS

| | | | |
|---|---|---|---|
| JP | 11-115175 | A | 4/1999 |
| JP | 2001212954 | A | 8/2001 |
| JP | 2015-047750 | A | 3/2015 |

* cited by examiner

*Primary Examiner* — Yaovi M Ameh
(74) *Attorney, Agent, or Firm* — Workman Nydegger

(57) ABSTRACT

A printing apparatus includes a transport unit for transporting a continuous sheet, a printing unit for printing by discharging ink to the continuous sheet, and a drying unit for drying the ink deposited on the continuous sheet. The drying unit includes a first heater unit for heating a printed surface of the continuous sheet and a second heater unit for heating the opposite surface of the continuous sheet to the printed surface. The first heater unit includes a plurality of first heaters that are disposed at the same position in a transport direction and that are arranged in width directions. The second heater unit includes a plurality of second heaters that are disposed at a position superposed on the first heater unit in the transport direction and that are disposed at positions between adjacent ones of first heating elements of the first heaters in the width directions.

11 Claims, 10 Drawing Sheets

PRINTING APPARATUS

This application is a continuation of U.S. application Ser. No. 15/416,808 filed Jan. 26, 2017, which claims priority under 35 U.S.C. § 119 to Japanese Patent Application No. 2016-015312, filed Jan. 29, 2016, the entireties of which are incorporated by reference herein.

BACKGROUND

1. Technical Field

The present invention relates to a printing apparatus, such as an ink jet type printer, that performs printing on a medium, for example, by discharging a liquid onto the medium transported onto a support table that supports the medium.

2. Related Art

A known example of this type of printing apparatus is a so-called hot-melt type printing apparatus (see, e.g., JP-A-11-115175) that, after depositing an ink that is an example of a liquid that is heated to melt and then solidifies onto a sheet of paper that is an example of a medium, heats the surface of the sheet of paper on which the liquid has been deposited so as to fix the ink to the sheet of paper. Such a printing apparatus has at a position above the sheet of paper a heater for fixing the ink.

It is preferable that this heater be provided as a common component part for a plurality of kinds of printing apparatuses that vary in the maximum width of paper that the apparatuses can carry out printing on, from the viewpoint of reducing the production costs of those kinds of printing apparatuses. To that end, it is conceivable to adopt a construction in which a plurality of small heaters are arranged in a direction orthogonal to a transport direction of the sheet of paper. This makes it possible to heat a sheet of paper throughout the entire width thereof even when the sheet of paper has a maximum printable paper width. Such a small heater includes a heating element (far-infrared quartz glass heater) that extends in a direction orthogonal to the transport direction and a reflector plate that concentrates far-infrared light emitted from the heating element onto the sheet of paper.

However, adjacent ones of the foregoing small heaters overlap with each other so that, for example, unbeatable areas at two opposite ends of a small heater in the directions orthogonal to the transport direction are superposed over heatable areas of adjacent small heaters when viewed in the transport direction. For example, as shown in FIG. 19, heaters 200 are provided at a downstream side of a printing unit 210 that prints on a sheet of paper MR in a transport direction YR of the sheet of paper MR and are disposed in a stepwise arrangement that extends from an end to the opposite end of the sheet of paper MR in the direction orthogonal to the transport direction YR as it extends downstream in the transport direction. Alternatively, as shown in FIG. 20, heaters 200 are provided at a downstream side of a printing unit 210 in a transport direction YR and are disposed in a zigzag arrangement that zigzags along the transport direction YR and extend in a direction orthogonal to the transport direction YR.

In the related-art printing apparatuses shown in FIG. 19 and FIG. 20, since the heaters 200 disposed in the directions orthogonal to the transport direction YR vary in position along the transport direction YR, the ink on the sheet of paper MR is heated after different amounts of time following the deposition of ink on the sheet of paper MR which vary along the width directions of the sheet of paper M. Therefore, it sometimes happens that the amounts of time between when the ink is deposited on the sheet of paper MR and when the deposited ink solidifies vary. As a result, the drying of the ink on the sheet of paper MR may become uneven or the shrinkage of the sheet of paper MR due to the ink deposited thereon may occur to varying degrees and therefore lead to damage to the medium.

SUMMARY

An advantage of some aspects of the invention is that a printing apparatus capable of inhibiting the amount of time from deposition of a liquid on a medium to solidification of the liquid on the medium from varying from one portion of the medium to another is provided.

Constructions of the foregoing printing apparatus and advantageous effects thereof will be described below.

A printing apparatus according to the invention includes a transport unit that transports a medium to a support table that supports the medium, a printing unit that is provided at a position facing the support table and that performs printing by depositing a liquid to the medium on the support table, and a drying unit that dries the liquid deposited on the medium. The drying unit includes a first heater unit capable of heating a printed side surface of the medium that has been subjected to be printing and a second heater unit capable of heating an opposite side surface of the medium to the printed side surface. The first heater unit includes a plurality of first heaters that are disposed at the same position in a transport direction of the medium and that are arranged in a direction orthogonal to the transport direction. Each of the first heaters includes a first heating element that heats the medium. The second heater unit includes at least one second heater that is disposed at a position superposed on the first heater unit in the transport direction and that is disposed at a position between adjacent first heating elements of the first heating elements in the direction orthogonal to the transport direction.

In this construction, since the plurality of first heaters and the at last one second heater are all disposed at the same position in the transport direction, the distances between the first heaters and the printing unit and the distance between the at least one second heater and the printing unit are equal to each other. Therefore, when a medium having been subjected to printing is transported to the drying unit, the printed medium can be heated in such a manner that the amount of time from the printing on the medium to the heating of the medium varies to a reduced degree or substantially does not vary from one portion of the medium to another.

The foregoing printing apparatus may further include a first control unit that generates a control signal that controls an operation of the printing apparatus, a plurality of second control units that control a state of supply of electric current to the first heaters and a state of supply of electric current to the at least one second heater on the basis of the control signal transmitted from the first control unit, and a control signal transmission path through which the control signal is transmitted from the first control unit to the second control units. The first control unit and the plurality of second control units may be connected in a parallel manner via the control signal transmission path.

This construction allows the electrical connecting construction of the first control unit and the second control units to be simplified in comparison with a construction in which a first control unit is connected to each of second control units separately via a plurality of control signal transmission paths that are parallel to each other and that are provided separately for each second control unit.

Furthermore, in the foregoing printing apparatus, the first heaters may be individually controllable.

According to this construction, useless consumption of electric power can be reduced by, for example, performing such a control as to supply electric power only to first heaters that face a medium according to the width of the medium, that is, the dimension of the medium in a direction that intersects the transport direction.

Furthermore, in the foregoing printing apparatus, the second heater unit may include a plurality of second heaters and the second heaters may be individually controllable.

According to this construction, useless consumption of electric power can be further reduced by, for example, performing such a control as to supply electric power only to second heaters that face a medium according to the width of the medium, that is, the dimension of the medium in a direction that intersects the transport direction.

Furthermore, in the foregoing printing apparatus, each of the first heating elements may have a longitudinal dimension in the transport direction instead of the direction orthogonal to the transport direction.

According to this construction, the duration of heating the medium increases in comparison with a first heater having a first heating element that has its longitudinal dimension not in the transport direction but in a direction that intersects the transport direction, provided that the medium transport speed is fixed. Therefore, even when the medium transport speed is increased, a duration of heating the medium can be secured, so that the throughput can be increased.

Still further, in the printing apparatus, the at least one second heater may include a second heating element that has a longitudinal dimension in the transport direction instead of the direction orthogonal to the transport direction.

According to this construction, the duration of heating the medium increases in comparison with a second heater having a second heating element that has its longitudinal dimension not in the transport direction but in a direction that intersects the transport direction, provided that the medium transport speed is fixed. Therefore, even when the medium transport speed is increased, a duration of heating the medium can be secured, so that the throughput can be increased.

BRIEF DESCRIPTION OF THE DRAWINGS

The invention will be described with reference to the accompanying drawings, wherein like numbers reference like elements.

DESCRIPTION OF EXEMPLARY EMBODIMENTS

An exemplary embodiment of the printing apparatus of the invention will be described hereinafter with reference to the accompanying drawings. In the following exemplary embodiment, the printing apparatus is an ink jet type printer that forms characters, images, etc. on a continuous sheet of paper as an example of a medium by discharging an ink as an example of a liquid to the continuous sheet. The ink in the exemplary embodiment is an aqueous resin ink that contains water as a solvent and that contains as a solute a pigment made of a resin.

Figure 1:
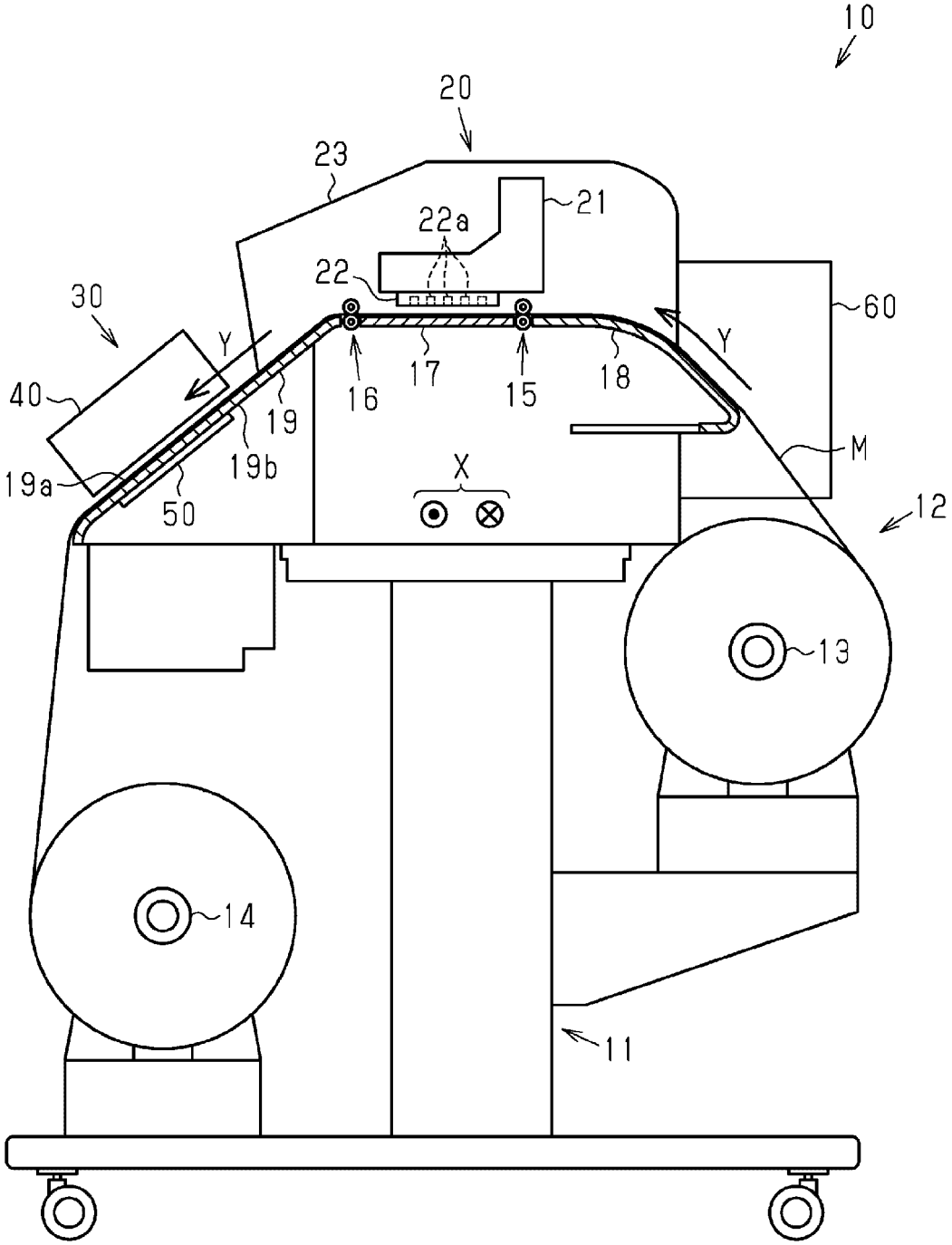
FIG. 1 is a side view schematically showing in section a structure of a portion of a printing apparatus according to an exemplary embodiment of the invention.

As shown in FIG. 1, a printing apparatus 10 includes a body frame 11. The body frame 11 includes a transport unit 12 that transports a continuous sheet of paper M along a transport path from an upstream side to a downstream side in a roll-to-roll method, a support table 17 that supports the continuous sheet M from below at an intermediate position on a transport path, and a printing unit 20 that performs printing on the continuous sheet M by discharging the ink to the continuous sheet M on the support table 17.

The transport unit 12 includes a feeding shaft 13 that supports a rolled continuous sheet M at an upstream side of the transport path and that feeds out the continuous sheet M to a downstream side along the transport path and a winding shaft 14 that is provided at a downstream side of the transport path to wind up the continuous sheet M fed out from the feeding shaft 13. The feeding shaft 13 and the winding shaft 14 are disposed rotatably about axes that extend in width directions of the continuous sheet M (hereinafter, referred to as "width directions X", which are directions orthogonal to the plane of the drawing of FIG. 1) that intersect the transport direction of the continuous sheet M (hereinafter, referred to as "transport direction Y"). The feeding shaft 13 is rotationally driven by a feeding-out motor (not graphically shown) in a direction in which the continuous sheet M is fed out and the winding shaft 14 is rotationally driven by a winding-up motor (not graphically shown) in a direction in which the continuous sheet M is wound up. Note that the width directions X in this exemplary embodiment are orthogonal to the transport direction Y.

The support table 17 is disposed to face the printing unit 20 across the continuous sheet M. That is, the printing unit 20 is provided at a position that faces the support table 17. The upstream side of the support table 17 along the transport path is provided with an upstream-side support portion 18 that supports the continuous sheet M from below. The downstream side of the support table 17 is provided with a downstream-side support portion 19 that supports the continuous sheet M from below. The upstream-side support portion 18 is disposed at an interval from the support table 17 and is curved so that the height of the upstream-side support portion 18 becomes greater toward the downstream side of the transport path. The downstream-side support portion 19 is provided at an interval from the support table 17 and is curved so that the height of the downstream-side support portion 19 becomes lower toward the downstream side of the transport path.

A sheet feed roller pair 15 that transports the continuous sheet M to the support table 17 while nipping the continuous sheet M is disposed on the transport path between the upstream-side support portion 18 and the support table 17. The sheet feed roller pair 15 is a rotationally driven by a sheet-feeding motor (not graphically shown) in such directions as to transport the continuous sheet M from the upstream side to the downstream side on the transport path.

A sheet discharge roller pair 16 that transports the continuous sheet M to a downstream-side support portion 19 while nipping the continuous sheet M is disposed on the transport path between the support table 17 and the downstream-side support portion 19. The sheet discharge roller pair 16 is rotationally driven by a sheet-discharging motor (not graphically shown) in such directions as to transport the continuous sheet M from the upstream side to the downstream side on the transport path.

The printing unit 20 includes a carriage 21 disposed above the support table 17 and a print head 22 supported on a lower end portion of the carriage 21 so as to face the support table 17. The printing unit 20 is covered by a cover member 23 that is provided so as to freely open and close relative to the body frame 11. Incidentally, a small gap is formed between the cover member 23 and the continuous sheet M that is transported.

The carriage 21 is supported by a guide member (not graphically shown) provided on the body frame 11 so that the carriage 21 is movable back and forth in the width directions X. The carriage 21 is moved back and forth in the width directions X on the basis of the driving of a carriage motor (not graphically shown). A facing surface of the print head 22 that faces the support table 17 has openings of many nozzles 22*a* that discharge the ink to the continuous sheet M. Furthermore, an ink cartridge (not graphically shown) that supplies the ink to the nozzles 22*a* is attached to the carriage 21.

The printing unit 20 performs printing on the continuous sheet M transported to the support table 17, by discharging the ink from the nozzles 22*a* of the print head 22 to the continuous sheet M transported to the support table 17 while moving the carriage 21 back and forth in the width directions X.

A drying unit 30 that drives the ink adhering to the continuous sheet M that has been subjected to printing is provided at the downstream side of the printing unit 20 along the transport path. The drying unit 30 includes a first heater unit 40 capable of heating a surface of the continuous sheet M which has been subjected to printing (hereinafter, referred to as "printed surface") after the continuous sheet M has been transported to the downstream-side support portion 19 and a second heater unit 50 capable of heating a reverse surface of the continuous sheet M that is the opposite surface thereof to the printed surface of the continuous sheet M transported to the downstream-side support portion 19. The first heater unit 40 is disposed at a position that faces, across an interval, a support surface 19*a* of the downstream-side support portion 19 which supports the continuous sheet M. The second heater unit 50 is disposed on a reverse surface 19*b* of the downstream-side support portion 19 which is opposite to the support surface 19*a*. Note that the reverse surface 19*b* is the opposite surface of the downstream-side support portion 19 to the support surface 19*a* (i.e., an internal side surface of the downstream-side support portion 19).

Figure 2:
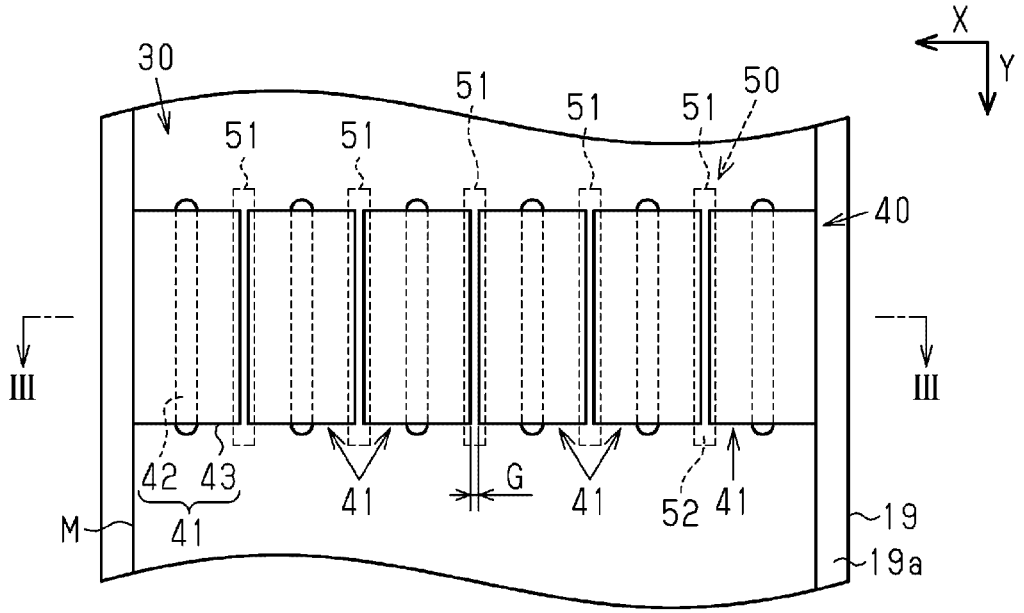
FIG. 2 is a plan view schematically showing a drying unit and a support table in the printing apparatus shown in FIG. 1.

As shown in FIG. 2, the first heater unit 40 includes a plurality of first heaters 41 (six first heaters 41 in this exemplary embodiment). The first heaters 41 are disposed at the same position in the transport direction Y and aligned with small gaps G in the width directions X. In this exemplary embodiment, the printing apparatus 10 is constructed to be able to handle a continuous sheet M with a maximum paper width of 64 inches. Therefore, the first heaters 41 are disposed so as to be able to provide heating throughout the entire paper width of 64 inches in the width directions X. Furthermore, in the exemplary embodiment, each first heater 41 has a dimension of 10 inches in the width directions X. Therefore, each gap G is set to a size of 4/5 inch.

Figure 3:
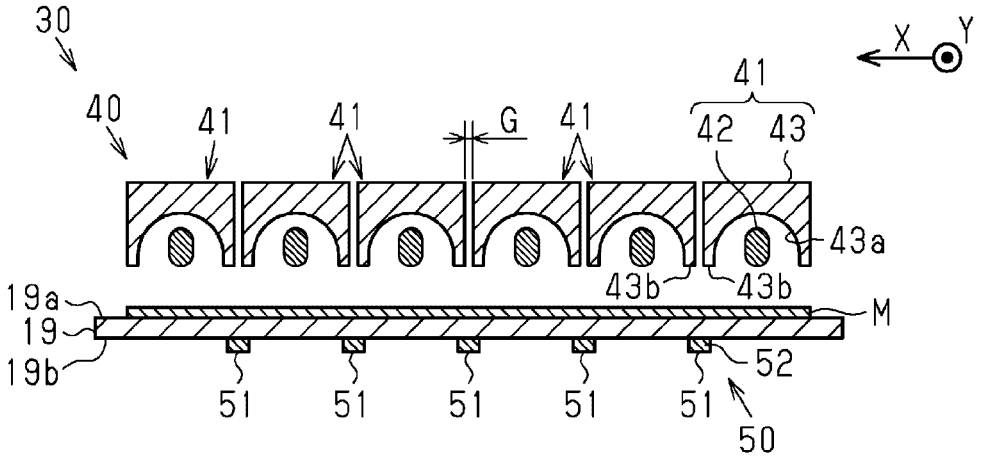
FIG. 3 is a sectional view taken along line III-III in FIG. 2.

Each first heater 41 is a so-called infrared (IR) heater that irradiates the printed surface of the continuous sheet M with near-infrared light to heat the printed surface of the continuous sheet M. Each first heater 41 is constructed so that the heating region (near-infrared-irradiated region) thereof has its longer or longitudinal dimension in the transport direction Y instead of the width directions X. Each first heater 41 includes a first heating element 42 that radiates near-infrared light when supplied with electric power and a reflector plate 43 that reflects near-infrared light from the first heating element 42 toward the printed surface of the continuous sheet M. The first heating element 42 of each first heater 41 and the reflector plate 43 thereof both have their longitudinal dimensions in the transport direction Y instead of the width directions X. An example of the first heating element 42 is a halogen lamp. The reflector plate 43 is made of a metal material such as an aluminum material, stainless steel, etc. As shown in FIG. 3, in each first heater 41, the reflector plate 43 is provided with a recess-shaped housing portion 43*a* that is curved to be open downward and that houses the first heating element 42. A surface of the housing portion 43*a* which forms the recess shape has been subjected to mirror surfacing so as to reflect near-infrared light from the first heating element 42. Thus, the reflector plate 43 of each first heater 41 is provided to cover the first heating element 42 from above in order to reflect near-infrared from the first heating element 42 toward the continuous sheet M. The gaps G define gaps between reflector plates 43 that are adjacent to each other in the width directions X.

Furthermore, as shown in FIGS. 2 and 3, the second heater unit 50 includes a plurality of second heaters 51 (five second heaters 51 in this exemplary embodiment). The second heaters 51 are disposed at the same position in the transport direction Y and aligned with predetermined intervals left therebetween in the width directions X. Furthermore, the second heaters 51 are disposed at the same position in the transport direction Y as the first heaters 41 and disposed at positions between mutually adjacent first heating elements 42 in the width directions X. In detail, the second heaters 51 are disposed corresponding to the gaps G between the first heater 41 adjacent to each other in the width directions X.

As shown in FIG. 3, the second heaters 51 are attached to the reverse surface 19*b* of the downstream-side support portion 19. An example of the second heaters 51 is a planar heater such as an aluminum foil heater. Each second heater 51 includes a second heating element 52 that produces heat when supplied with electric power. An example of the second heating element 52 is a cord heater. As shown in FIG. 2, each second heating element 52 is constructed and arranged so that the longitudinal dimension thereof lies in the transport direction Y instead of the width directions X. The second heaters 51 all have the same construction. Therefore, the productivity of the second heaters 51 improves.

Next, an electrical construction of the printing apparatus 10 will be described with reference to FIGS. 1 and 4.

As shown in FIG. 1, the printing apparatus 10 includes a control apparatus 60 that performs overall control of the operation of the printing apparatus 10. The control apparatus 60 is mounted on the body frame 11 at the upstream side of the printing unit 20 in the transport direction Y. The control apparatus 60 receives a print job that is, for example, sent via an interface that allows a personal computer (not graphically shown) to cause a printing operation of the printing apparatus 10. The print job contains information regarding the size of the continuous sheet M (e.g., a paper width of 74 inches, 64 inches, 32 inches, etc.), characters and images to be printed, etc.

Figure 4:
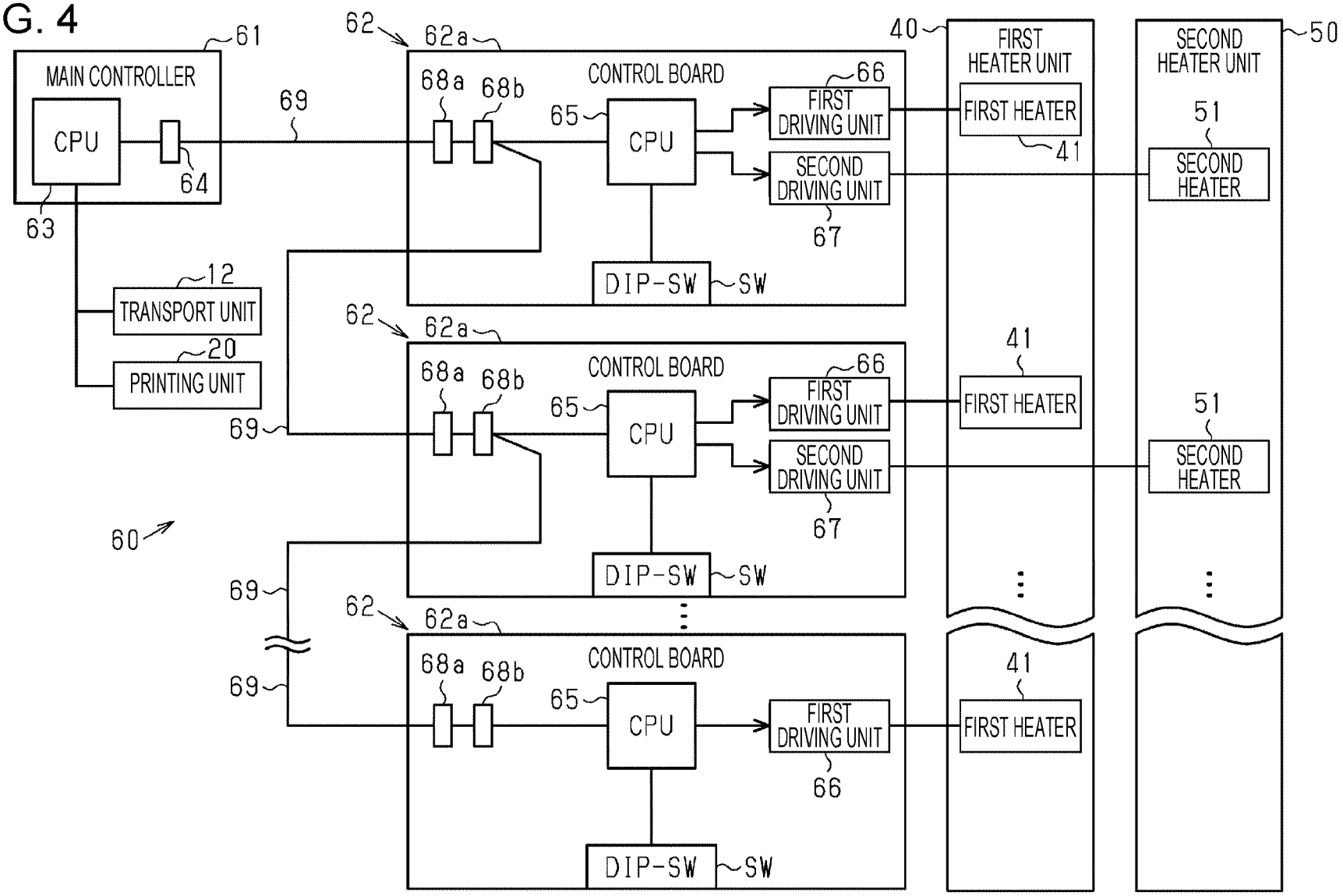
FIG. 4 is a block diagram showing an electrical construction of the printing apparatus shown in FIG. 1.

As shown in FIG. 4, the control apparatus 60 includes a main controller 61 that is an example of a first control unit and a plurality of control boards 62 (three control boards 62 in FIG. 4) that are an example of a second control unit electrically connected to the main controller 61.

The main controller 61 includes a CPU 63 that generates control signals for controlling motors of the transport unit 12, motors of the printing unit 20, and the printing operations thereof, and the operations of the drying unit 30 and further includes a connector 64 for electrically connecting selectively to one of a plurality of control boards 62.

On a printed board 62*a* of each control board 62 there are mounted a CPU 65, a first driving unit 66, a second driving unit 67, two connectors 68*a* and 68*b*, and a dual in-line package (DIP) switch SW. As for each control board 62, the CPU 65 is electrically connected to the CPU 63 of the main controller 61 through a connector 68*b* and a wire harness 69 that connects a connector 68*a* to the connector 64 of the main controller 61. The first driving unit 66 is electrically connected to one of the first heaters 41 of the first heater unit 40. The second driving unit 67 is electrically connected to one of the second heaters 51 of the second heater unit 50. The DIP switch SW is electrically connected to the CPU 65.

The CPU 65 of each control board 62 generates a drive signal for the first heater 41 and a drive signal for the second heater 51 on the basis of a control signal from the CPU 63 of the main controller 61, and outputs the drive signals to the first driving unit 66 and the second driving unit 67. On the basis of the received drive signal for the first heater 41, the first driving unit 66 supplies electric current to and thus drives the first heater 41 that corresponds to the first driving unit 66, among the plurality of first heaters 41. The second driving unit 67, on the basis of the received drive signal for the second heater 51, supplies electric current to and thus drives the second heater 51 that corresponds to the second driving unit 67, among the plurality of second heaters 51. The DIP switch SW has a construction that includes an arrangement of a plurality of switches, and sets address information about each CPU 65 on the basis of the on/off states of these switches. Note that in this exemplary embodiment, since the number of second heaters 51 is one less than the number of first heaters 41, one of the control boards 62 does not have a second driving unit 67.

Furthermore, the connector 68*b* of each control board 62 and the connector 68*b* of a control board 62 adjacent to that control board 62 are electrically connected by a wire harness 69. Therefore, the CPUs 65 of the plurality of control boards 62 are electrically connected to the CPU 63 of the main controller 61. Note that although the control boards 62 appear to be connected in series, the control boards 62 are connected in parallel in terms of an electrical circuit. Furthermore, the foregoing wire harnesses 69 are an example of a control signal transmission path that transmits control signals from the main controller (first control unit) to a plurality of control boards 62 (second control units).

According to this construction, since the control apparatus 60 includes the first driving units 66 that correspond to the plurality of first heaters 41 and the second driving units 67 that correspond to the plurality of second heaters 51, the first heaters 41 can be individually controlled and the second heaters 51 can also be individually controlled. Furthermore, since the CPUs 65 of the control boards 62 are individually assigned address information, the CPU 63 of the main controller 61 can output a control signal to the CPU 65 with designated address information among the CPUs 65 of the control boards 62, on the basis of the address information. Therefore, the control apparatus 60 is capable of selecting any one of the first heaters 41 and any one of the second heaters 51 to which electric power is to be supplied.

By the way, users have various demands. For example, one user desires to print on a continuous sheet M having a large paper width, and another user desires that the printing apparatus 10 be small in size even though the printing apparatus 10 can handle only a small paper width. In view of such circumstances, it is preferable that a plurality of kinds of printing apparatuses 10 different in the maximum printable paper width be produced as commercial products. Since such different printing apparatuses 10 vary in the size of the first heater unit 40 and the size the second heater unit 50 in the width directions X, it is necessary to produce first heater units 40 and second heater units 50 of various sizes according to the kinds of the printing apparatuses 10.

If first heater units 40 and second heater units 50 that are dedicated separately to a plurality of kinds of printing apparatuses 10 different in the maximum printable paper width are produced, the production costs of the printing apparatuses 10 become high. Therefore, it is preferable to produce a first heater unit 40 and a second heater unit 50 common to or compatible with all of such printing apparatuses 10. In particular, the first heating elements 42 (halogen lamps) and the reflector plates 43 are costly in comparison with, for example, planar heaters, it is preferable that these component parts be commonized.

Figure 5:
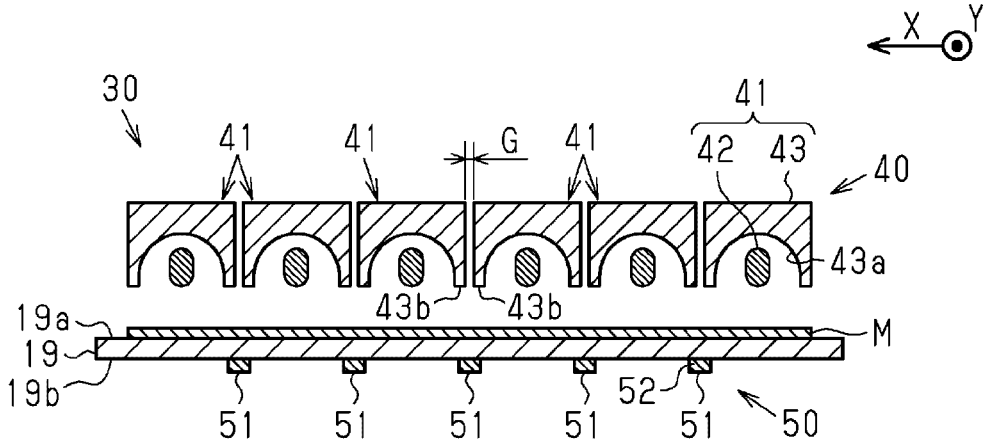
FIG. 5 is a sectional view schematically showing a drying unit and a support table that are compatible with a maximum printable paper width of 64 inches.
Figure 6:
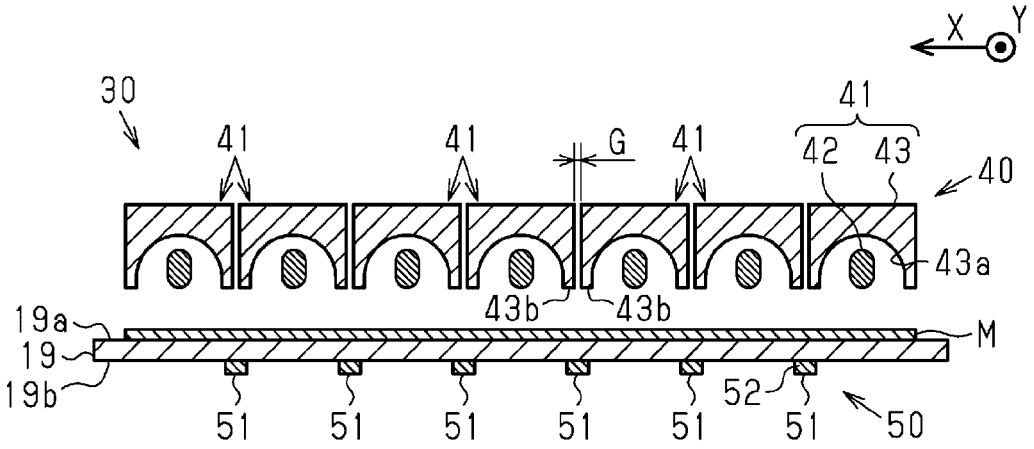
FIG. 6 is a sectional view schematically showing a drying unit and a support table that are compatible with a maximum printable paper width of 74 inches.
Figure 7:
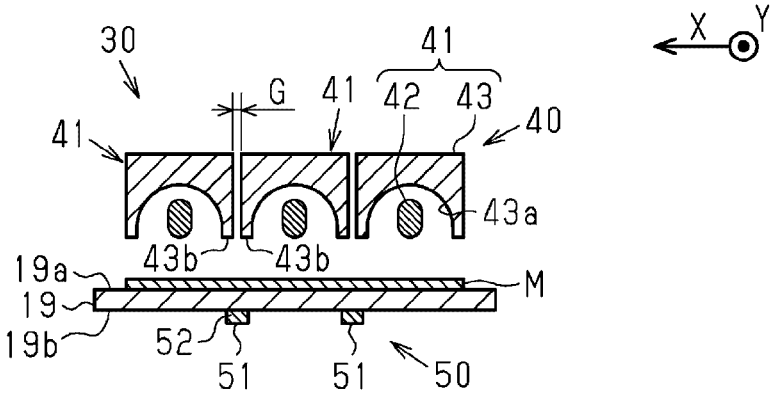
FIG. 7 is a sectional view schematically showing a drying unit and a support table that are compatible with a maximum printable paper width of 32 inches.

In the first heater unit 40 and the second heater unit 50 in the exemplary embodiment, the first heaters 41 are aligned in the width directions X according to the size of the first heater unit 40 in the width directions X and the second heaters 51 are disposed at positions between adjacent ones of the first heating elements 42. For example, in a first heater unit 40 for a printing apparatus 10 compatible with a maximum paper width of 64 inches as shown in FIG. 5, six first heaters 41 are aligned in the width directions X. Accordingly, second heaters 51 (five second heaters 51 in FIG. 5) are disposed so that each of the gaps between the first heating elements 42 in the width directions X faces one of the second heaters 51. Furthermore, in a first heater unit 40 for a printing apparatus 10 compatible with a maximum paper width of 74 inches as shown in FIG. 6, seven first heaters 41 are aligned in the width directions X. Accordingly, second heaters 51 (six second heaters 51 in FIG. 6) are disposed so that each of the gaps between the first heating elements 42 in the width directions X faces one of the second heaters 51. Furthermore, in a first heater unit 40 for a printing apparatus 10 compatible with a maximum paper width of 32 inches as shown in FIG. 7, three first heaters 41 are aligned in the width directions X. Accordingly, second heaters 51 (two second heaters 51 in FIG. 7) are disposed so that each of the gaps between the first heating elements 42 faces one of the second heaters 51. Incidentally, the gaps G in FIG. 6 are set to 4/6 inch (2/3 inch) and the gaps G in FIG. 7 are set to 1 inch.

There are cases where the printing apparatus 10 performs printing on a continuous sheet of paper M whose width is smaller than the maximum paper width. In such cases, it is preferable to supply electric power only to the first heater or heaters 41 and the second heater or heaters 51 that face the continuous sheet M, from the viewpoint of reducing useless consumption of electric power. Therefore, the control apparatus 60 executes a heater selecting process of selecting one or more of the first heaters 41 and one or more of the second heaters 51 to which to supply electric power. This heater selecting process will be described with reference to FIG. 8 to FIG. 10.

Figure 8:
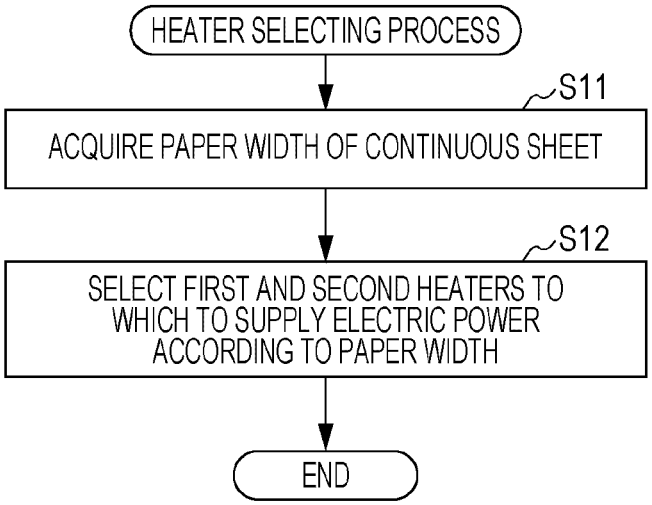
FIG. 8 is a flowchart showing a procedure of a heater selecting process that the printing apparatus shown in FIG. 1 executes.

As shown in a flowchart of FIG. 8, the control apparatus 60 acquires information about the paper width of the continuous sheet M on the basis of the print job received (step S11). Then, the control apparatus 60 selects one or more of the first heaters 41 and one or more of the second heaters 51 to which to supply electric power on the basis of the acquired information about the paper width of the continuous sheet M (step S12).

Figure 9:
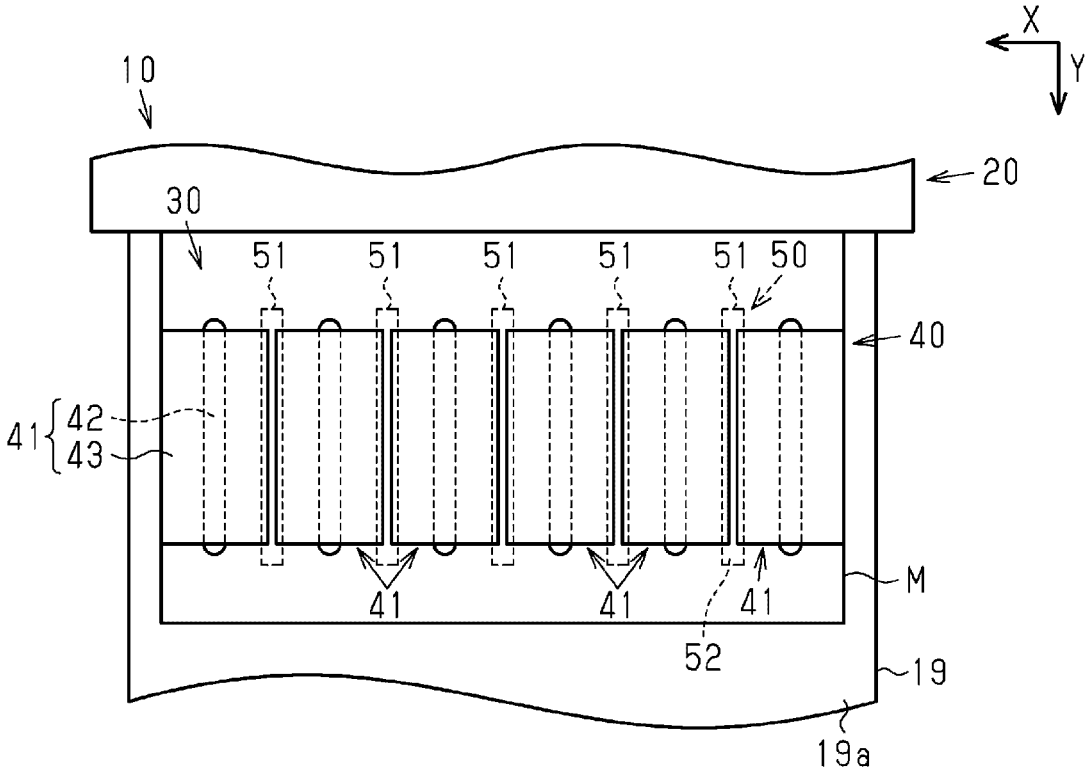
FIG. 9 is a plan view schematically showing a drying unit and a support table when a sheet having a paper width of 64 inches is used in the printing apparatus shown in FIG. 1.
Figure 10:
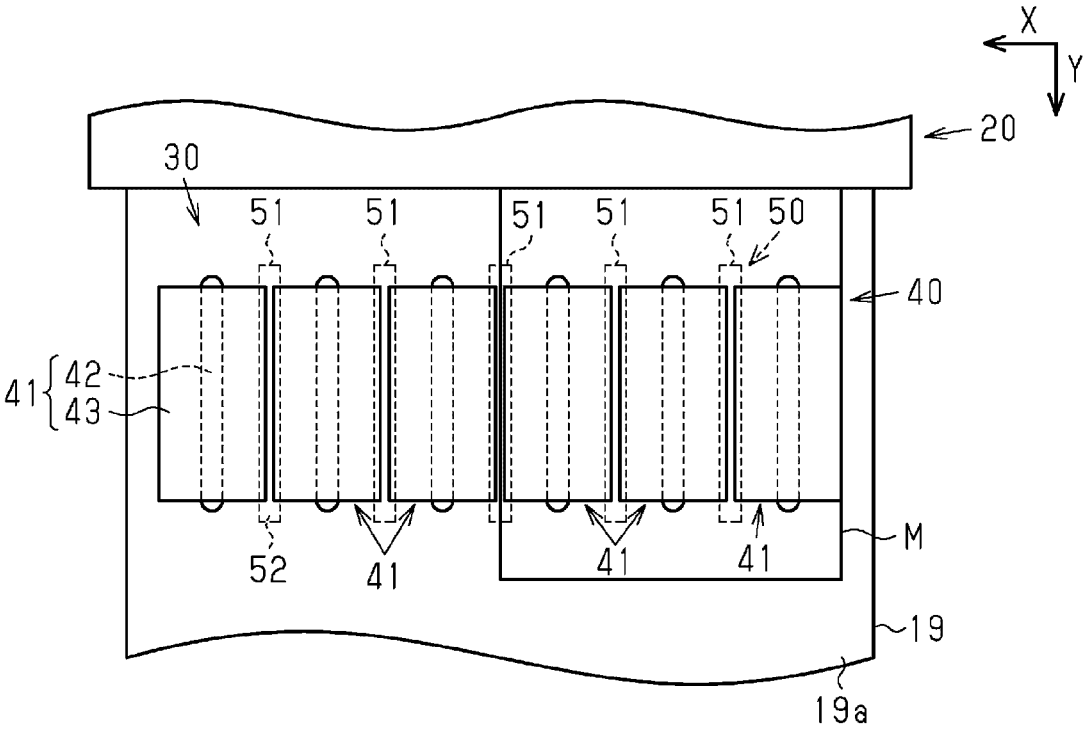
FIG. 10 is a plan view schematically showing a drying unit and a support table when a sheet having a paper width of 32 inches is used in the printing apparatus shown in FIG. 1.

Concretely, for example, as shown in FIG. 9, in the case of printing on a continuous sheet M having a paper width of 64 inches, the control apparatus 60 supplies electric power to all the first heaters 41 and all the second heaters 51 in order to heat the continuous sheet M throughout its entire paper width of 64 inches. For example, in the case of printing on a continuous sheet M having a paper width of 32 inches as shown in FIG. 10, the control apparatus 60 supplies electric power to three first heaters 41 on the right side in the drawing and two second heaters 51 on the right side in the drawing, among the first heaters 41 and the second heaters 51, in order to heat the continuous sheet M throughout its entire paper width of 32 inches. That is, the control apparatus 60 avoids supplying electric power to the three first heaters 41 on the left side in the drawing and the three second heaters 51 on the left side in the drawing, among the first heaters 41 and the second heaters 51, so that useless consumption of electric power can be reduced.

Next, operation of the exemplary embodiment will be described.

Figure 11:
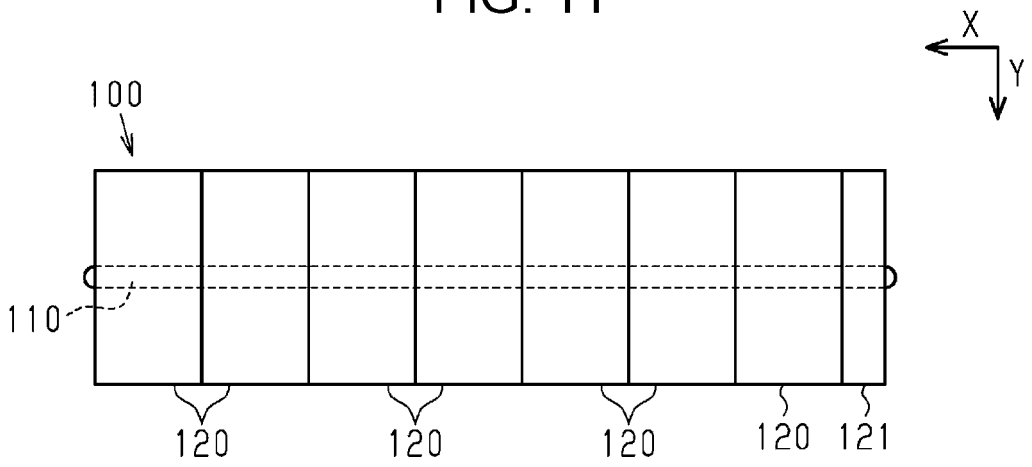
FIG. 11 is a plan view schematically showing a drying unit compatible with a maximum printable paper width of 74 inches in a printing apparatus according to a comparative example.
Figure 12:
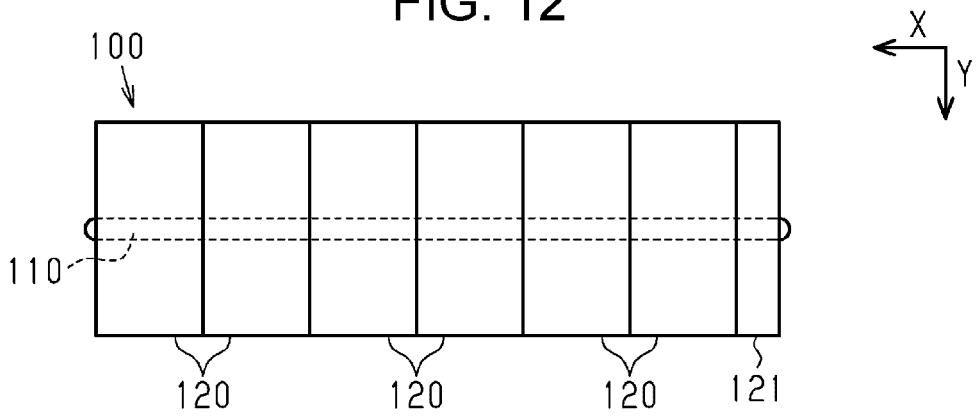
FIG. 12 is a plan view schematically showing a drying unit compatible with a maximum printable paper width of 64 inches in a printing apparatus according to a comparative example.
Figure 13:
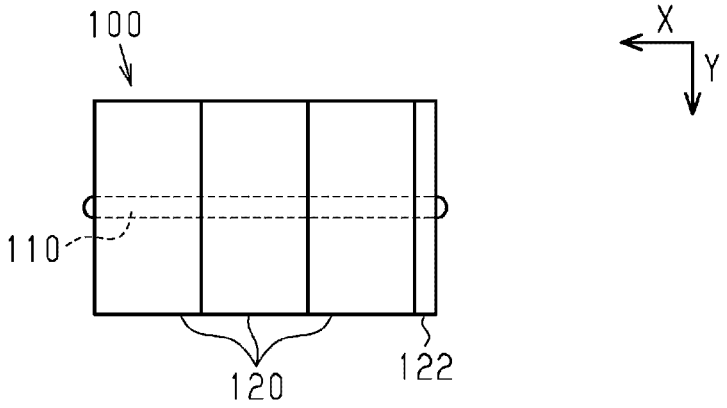
FIG. 13 is a plan view schematically showing a drying unit compatible with a maximum printable paper width of 32 inches in a printing apparatus according to a comparative example.

For example, in the case where the second heater unit 50 is omitted and the first heater unit 40 alone is employed to heat a continuous sheet M throughout its entire dimension in the width directions X, it is preferable that the printing apparatus 10 have a construction in which a first heating element 42 extends or is elongated in the width directions X. For example, as shown in FIG. 11 to FIG. 13, in the case of producing drying units (first heater units 100) separately for each of continuous sheets M having paper widths of 74 inches, 64 inches, and 32 inches, the first heating elements 110 vary in the length in the directions X corresponding to the different paper widths of the continuous sheets M, that is, common first heating elements 110 cannot be employed.

Furthermore, since the first heating element 110 extends beyond each of the reflector plates 120 that has a dimension of 10 inches in the width directions X, the reflector plates 120 need to be aligned without a gap therebetween in the width directions X in order to reflect near-infrared light from the first heating element 110 toward the printed surface of the continuous sheet M. Therefore, with regard to first heater units 100 compatible with paper widths of 74 inches and 64 inches as shown in FIG. 11 and FIG. 12, respectively, reflector plates 121 having a dimension of 4 inches in the width directions X need to be formed separately for each first heater unit 100. Furthermore, with regard to first heater units 100 compatible of a paper width of 32 inches as shown in FIG. 13, a reflector plate 122 having a dimension of 2 inches in the width directions X needs to be formed separately for each first heater unit 100. Thus, in the case where drying units are constructed by using only first heater units 100, it is difficult to commonize first heating elements 110 and reflector plates 120 (121 and 122) across various drying units.

Therefore, as shown in FIG. 5 to FIG. 7, in the first heater unit 40 of the exemplary embodiment, the number of first heaters 41 that each include a common first heating element 42 that extends or is elongated in the transport direction Y and a common reflector plate 43 that extends or is elongated in the transport direction Y is set according to the maximum printable paper width. As a result, the first heating elements 42 and the reflector plates 43 can be used as common component parts for different printing apparatuses 10 that vary in maximum printable paper width.

However, due to the construction in which first heating elements 42 are disposed at intervals in the width directions X, the amounts of radiation from the first heating elements 42 to regions in the continuous sheet M that correspond to opening end portions 43*b* of the reflector plates 43 that are adjacent to each other in the width directions X are smaller than the amounts of radiation from the first heating elements 42 to the regions in the continuous sheet M in the width directions X (regions that correspond to the housing portions 43*a* of the reflector plates 43). In particular, in this exemplary embodiment, since the gaps G are formed between the first heaters 41 adjacent to each other in the width directions X so that the length in the width directions X of the first heaters 41 aligned in the width directions X is equal to the paper width, the distances between the first heating elements 42 adjacent to each other in the width directions X is accordingly large. Therefore, there is an increased tendency that the amounts of radiation from the first heating elements 42 to the regions in the continuous sheet M that correspond to the gaps G are smaller than the amounts of radiation from the first heating elements 42 to the other regions in the continuous sheet M in the width directions X. As a result, the regions in the continuous sheet M that correspond to the gaps G and the opening end portions 43*b* of the reflector plates 43 have lower temperature.

Therefore, in the drying unit 30 in the exemplary embodiment, the second heaters 41 are disposed on portions of the downstream-side support portion 19 that correspond to the gaps G. Due to this, the second heaters 51 heat, through the downstream-side support portion 19, the regions in the continuous sheet M that correspond to the gaps G and the opening end portions 43*b* of the reflector plates 43, thus compensating for the reduction in the temperature of the regions in the continuous sheet M that correspond to the gaps G and the opening end portions 43*b*.

The exemplary embodiment achieves the following advantageous effects.

(1) Since the plurality of first heaters 41 and the plurality of second heaters 51 are aligned in the width directions X, all of the first heaters 41 and the second heaters 51 are disposed at the same position in the transport direction Y. Because of this, the distances between the first heaters 41 and the printing unit 20 and the distances between the second heaters 51 and the printing unit 20 are equal, so that when the printed continuous sheet M is transported to the drying unit 30, the continuous sheet M can be heated in such a manner that the amount of time from the printing on the continuous sheet M to the heating thereof varies to a reduced degree or substantially does not vary from one portion of the continuous sheet M to another. As a result, occurrence of uneven drying of the ink on the continuous sheet M can be inhibited and therefore occurrence of damage to a medium caused by different degrees of shrinkage of a continuous sheet M arising from the adhesion of the ink to the continuous sheet M can be inhibited.

(2) Since the control boards 62 are electrically connected by the wire harness 69, the main controller 61 needs only to be electrically connected to one of the control boards 62. Therefore, the construction of electrical connection between the main controller 61 and the plurality of control boards 62 can be simplified in comparison with a construction in which a main controller 61 is connected to all of control boards 62 via wire harnesses 69 provided in parallel separately for each control board 62.

(3) Since the control apparatus 60 is capable of controlling each one of the first heaters 41 separately, it is possible to supply electric power only to one or more of the first heaters 41 which face the continuous sheet M according to the paper width of the continuous sheet M. Therefore, useless consumption of electric power can be reduced.

(4) Since the control apparatus 60 is capable of controlling each one of the second heaters 51 separately, it is possible to supply electric power only to one or more of the second heaters 51 which faces the continuous sheet M according to the paper width of the continuous sheet M. Therefore, useless consumption of electric power can be further reduced.

(5) Since the first heating element 42 of each first heater 41 has its longer or longitudinal dimension in the transport direction Y instead of the width directions X, the duration of heating the continuous sheet M increases in comparison with first heater units 100 as shown in FIGS. 11 to 13 which are provided with first heating elements 110 having their longer or longitudinal dimension in the width directions X instead of the transport direction Y, provided that the transport speed of the continuous sheet M is fixed. Therefore, in the exemplary embodiment, even if the transport speed of the continuous sheet M is increased, a duration for drying the ink deposited on the continuous sheet M can be secured, so that the throughput can be increased.

(6) Since the second heating element 52 of each second heater 51 has its longer or longitudinal dimension in the transport direction Y instead of the width directions X, the duration of heating the continuous sheet M increases in comparison with a construction in which second heating elements have their longer or longitudinal dimension in the width directions X instead of the transport direction Y, provided that the transport speed of the continuous sheet M is fixed. Therefore, in the exemplary embodiment, even if the transport speed of the continuous sheet M is increased, a duration for drying the ink deposited on the continuous sheet M can be secured, so that the throughput can be increased.

(7) Since the control apparatus 60 includes a plurality of control boards 62 corresponding to the first heaters 41 and the second heaters 51, the number of control boards 62 can be changed according to the numbers of first heaters 41 and second heaters 51. Therefore, it is possible to easily produce control apparatuses 60 suitable for a plurality of kinds of printing apparatuses 10 varying in maximum printable paper width. Therefore, control boards 62 can be commonized across various printing apparatuses 10 and the control apparatus 60 can be reduced in size for a printing apparatus 10 whose maximum printable paper width is small.

Modifications

The foregoing exemplary embodiment may be modified or changed as in the following modifications. The exemplary embodiment and any one of the following modifications can be arbitrarily combined.

The gaps G between the first heaters 41 adjacent to each other in the width directions X may be omitted. That is, the first heaters 41 may be aligned so that the first heaters 41 adjacent to each other in the width directions X are in contact in the width directions X. In this case, the region irradiated by the first heaters 41 is smaller in the width directions X than the maximum printable paper width. Therefore, in order to heat an end portion of the continuous sheet M in the width directions X which is outside the region irradiated by the first heaters 41 (hereinafter, referred to as "end region"), the reverse surface 19*b* of the downstream-side support portion 19 is provided with a second heater 51 of the second heater unit 50.

Figure 14:
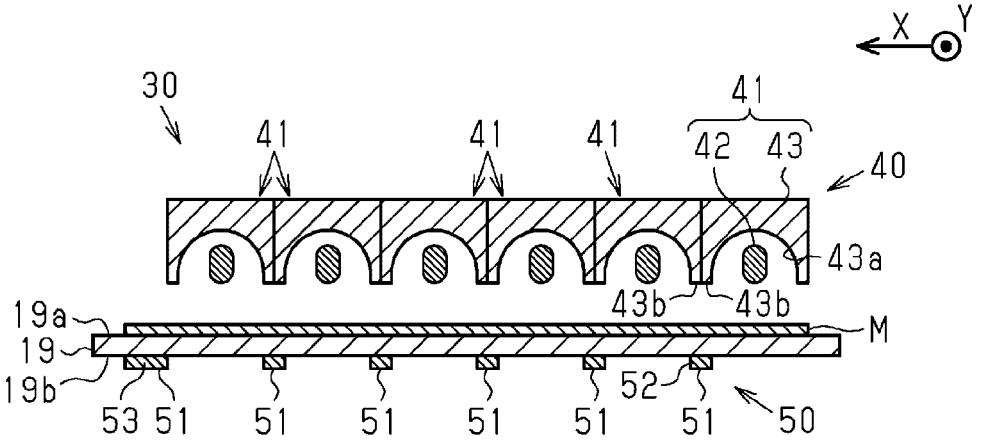
FIG. 14 is a sectional view schematically show a drying unit compatible with a maximum printable paper width of 64 inches in a printing apparatus according to a modification.
Figure 15:
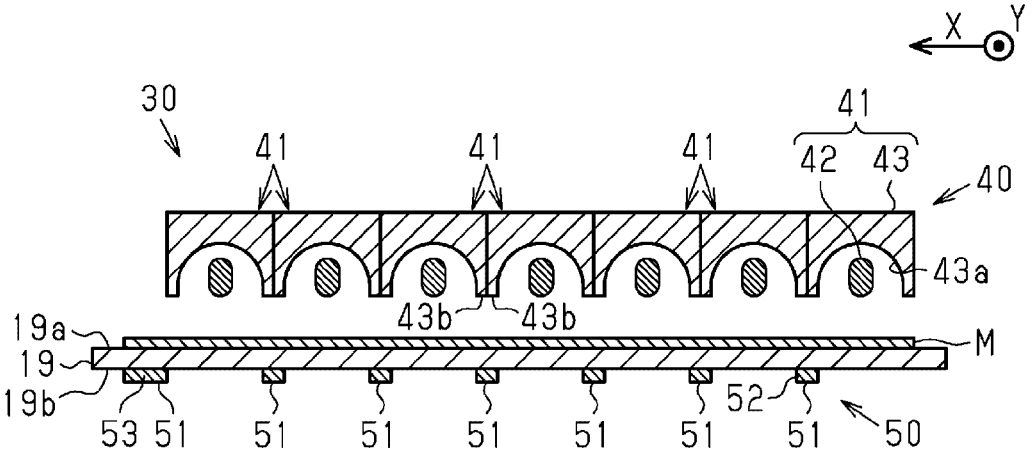
FIG. 15 is a sectional view schematically show a drying unit compatible with a maximum printable paper width of 74 inches in a printing apparatus according to a modification.
Figure 16:
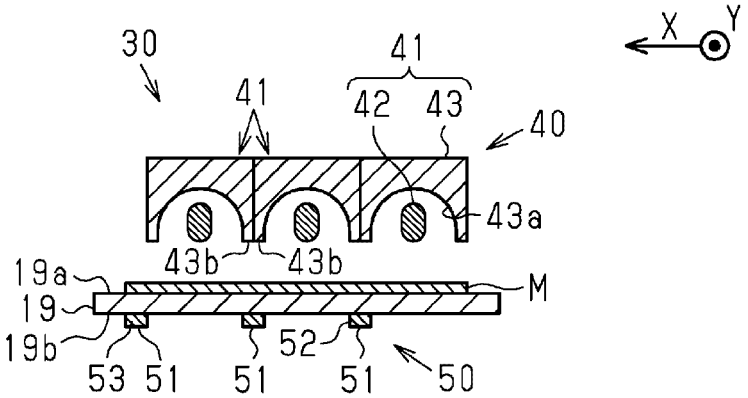
FIG. 16 is a sectional view schematically showing a drying unit compatible with a maximum printable paper width of 32 inches in a printing apparatus according to a modification.

Concretely, in first heater units 40 compatible with paper widths of 74 inches and 64 inches as shown in FIG. 14 and FIG. 15, respectively, the continuous sheet M is larger by 4 inches in the width directions X than the entire region irradiated by all the first heaters 41. Therefore, at a position corresponding to the 4-inch-wide region of the continuous sheet M, a second heater 51 is attached to the reverse surface 19*b* of the downstream-side support portion 19. Furthermore, in a first heater unit 40 compatible with a paper width of 32 inches as shown in FIG. 16, the continuous sheet M is larger by 2 inches in the width directions X than the entire region irradiated by all the first heaters 41. Therefore, at a position corresponding to the 2-inch-wide region of the continuous sheet M, a second heater 51 is attached to the reverse surface 19*b* of the downstream-side support portion 19.

Thus, the second heater 51 that heats the end region of the continuous sheet M includes an end portion heating element 53 that is an example of a second heating element. An example of the end portion heating element 53 is a cord heater. The end portion heating element 53 gives an amount of heat to the downstream-side support portion 19 so that the temperature of the end region of the continuous sheet M becomes equal to the temperature of the region in the continuous sheet M other than the end region in the width directions X. Therefore, the amount of heat that the end portion heating element 53 gives to the downstream-side support portion 19 is larger than the amount of heat that a second heating element 52 gives to the downstream-side support portion 19. Incidentally, a second driving unit (not graphically shown) that drives the end portion heating element 53 is provided, for example, on a control board 62 that has only the first driving unit 66, among the plurality of control boards 62 in FIG. 4.

Figure 17:
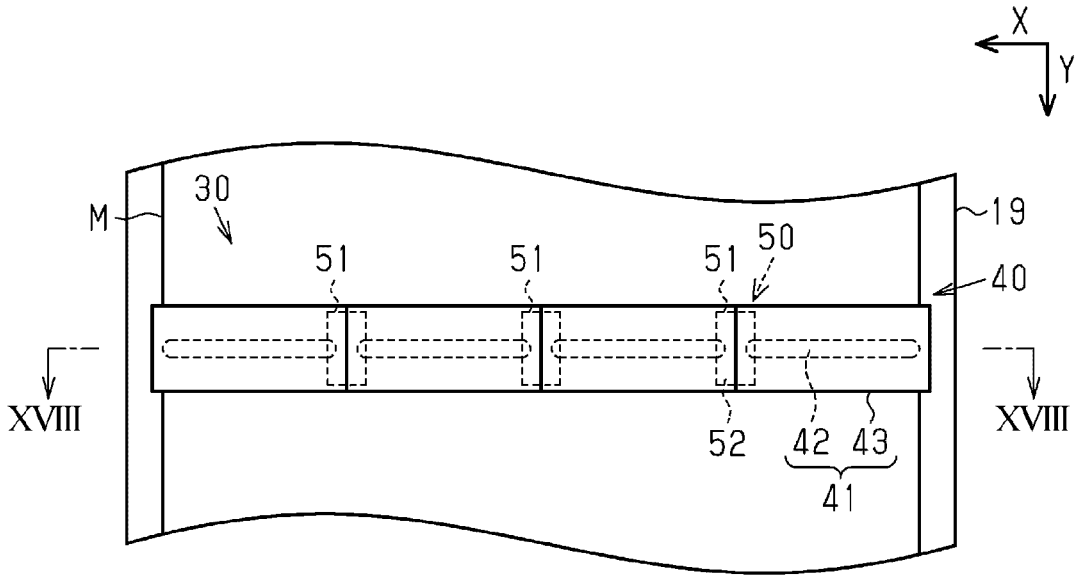
FIG. 17 is a plan view schematically showing a drying unit and a support table in a printing apparatus according to another modification.
Figure 18:
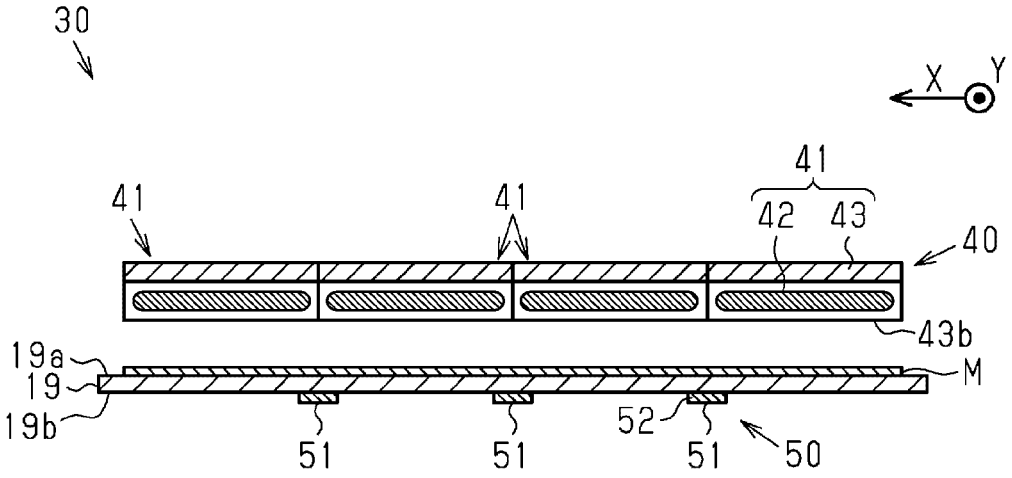
FIG. 18 is a sectional view taken along line XVIII-XVIII in FIG. 17.
Figure 19:
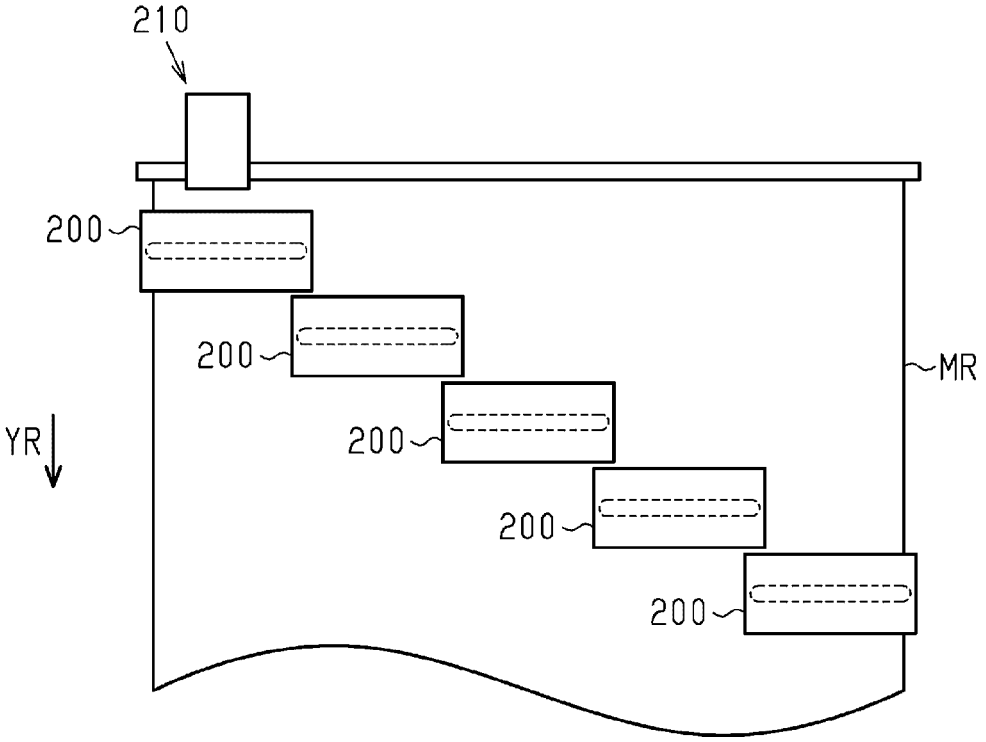
FIG. 19 is a plan view schematically showing a printing unit and heaters in a related-art printing apparatus.
Figure 20:
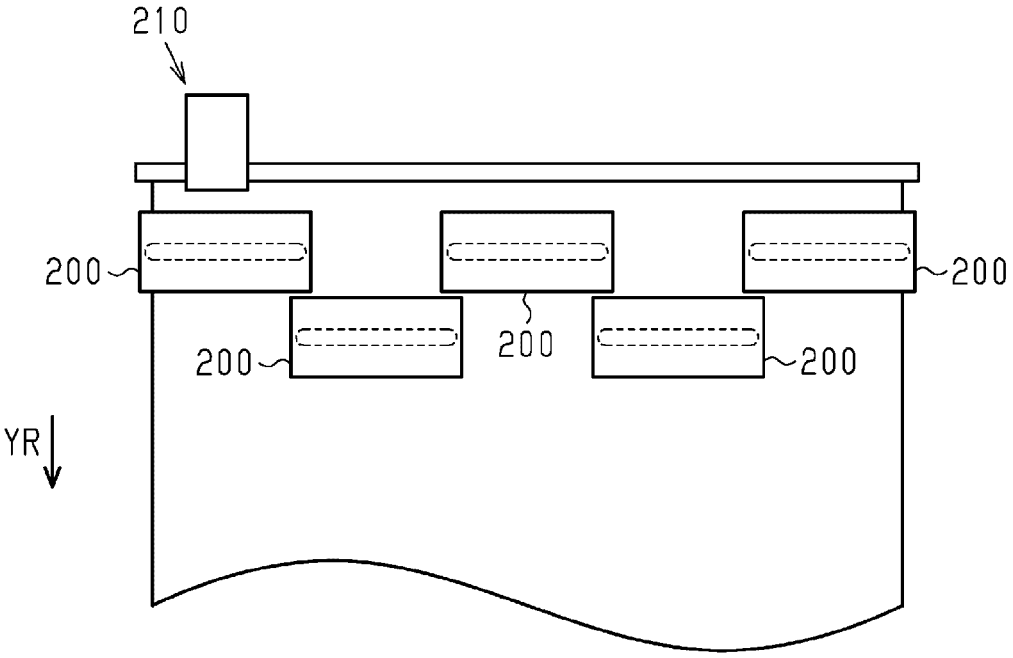
FIG. 20 is a plan view schematically showing a printing unit and heaters in another related-art printing apparatus.

As shown in FIG. 17, a plurality of first heaters 41 may be aligned in the width directions X so as to have their longitudinal dimensions in the width directions X instead of the transport direction Y. In this case, as shown in FIG. 18, the second heating elements 52 of the second heaters 51 are disposed at positions between the first heating elements 42 of the first heaters 41 in the width directions X. The length of each second heating element 52 in the transport direction Y in FIG. 17 is shorter than the length of each second heating element 52 in the foregoing exemplary embodiment in the transport direction Y. Furthermore, as shown in FIG. 17 and FIG. 18, the second heating elements 52 may be provided so as to overlap with end portions of the first heating elements 42 in the width directions X.

Although the numbers of first heaters 41 and the numbers of second heaters 51 for continuous sheets M whose paper widths are 64 inches, 72 inches, and 32 inches are exemplified in the foregoing exemplary embodiment, the number of first heaters 41 and the number of second heaters 51 can be arbitrarily set according to the maximum printable paper width. For example, in the case where the paper width of a continuous sheet M is smaller than 32 inches, two first heaters 41 and one second heater 51 may be provided. In this case, a second driving unit 67 is mounted only on one control board 62.

Each first heater 41 does not need to be an infrared heater as long as each first heater 41 is able to heat the printed surface of the continuous sheet M. For example, each first heater 41 may be constructed to heat the continuous sheet M by using microwave radiation or may also be constructed to heat the continuous sheet M by heat conduction via hot air instead of heat radiation.

Each second heater 51 does not need to be a cord heater as long as each second heater 51 is able to heat the reverse surface of the continuous sheet M. For example, each second heater 51 may be an IR heater like the first heaters 41, may be constructed to heat the continuous sheet M via the downstream-side support portion 19 by using microwave radiation, or may also be constructed to heat via the downstream-side support portion 19 the continuous sheet M by heat conduction via hot air instead of radiation.

The second heaters 51 may be provided as one planar heater that is formed over the entire region in the reverse surface 19*b* of the downstream-side support portion 19 which faces the first heater unit 40. In this case, one second driving unit 67 suffices to heat the entire region in the reverse surface 19*b* of the downstream-side support portion 19 which faces the first heater unit 40, regardless of the paper width of the continuous sheet M.

A plurality of first heater units 40 and a plurality of second heater units 50 may be arranged in the transport direction Y.

The control apparatus 60 may, instead of executing the heater selecting process, supply electric power to all the first heaters 41 and all the second heaters 51 regardless of the paper width of the continuous sheet M.

In a construction in which the main controller 61 is electrically connected in parallel to a plurality of control boards 62, the main controller 61 may be connected to the control boards 62 via their respective wire harnesses 69.

The printing unit 20 may instead have a so-called line head in which an elongated print head corresponding to the entire dimension of the support table 17 in the width directions X is disposed and fixed.

The printing apparatus 10 is not limited to a construction equipped only with the print function but may also be a multifunction machine.

The medium is not limited to the continuous sheet M but may also be a cut sheet of paper, a film made of resin, a metal foil, a metal film, a resin-metal composite film (laminate film), a woven fabric, a non-woven fabric, a ceramic sheet, etc.

The ink may be a solution that does not contain water.

The recording material for use for printing may also be a fluid other than ink (a liquid, a liquid material made by dispersing or mixing particles of a functional material in a liquid, a fluidal material such as gel, a solid that can be ejected as a fluid). For example, the recording material may be a liquid material that contains in the form of a dispersion or solution a material such as an electrode material or a color material (pixel material) for use in the production of a liquid crystal display, an electroluminescence (EL) display, a surface emitting display, etc. and that is ejected for printing in the production.

Furthermore, the printing apparatus 10 may be a fluidal material ejecting apparatus that ejects a fluidal material such as gel (e.g., a physical gel) or a powder-and-granular material ejecting apparatus (e.g., a toner jet type recording apparatus) that ejects a solid, for example, a powder (powder-and-granular material) such as toner. Incidentally, in this specification, the "fluid" refers to a concept that does not include a fluid made up of only gas and the "fluid" includes, for example, liquids (including inorganic solvents, organic solvents, solutions, liquid resins, liquid metals (metal melts), etc.), liquid materials, fluidal materials, powder-and-granular materials (including granule and powder), etc.

The printing apparatus 10 is not limited to an apparatus that prints on a medium, such as a continuous sheet M, by discharging a liquid directly to the medium but may also be printing apparatuses for planographic printing, relief printing, intaglio printing, screen printing, etc. in which ink applied to a printing plate is transferred to a medium.

What is claimed is:

1. A drying apparatus comprising:

a first heating unit configured to heat a first surface of a medium, the medium being printed and transported in a transport direction;

a second heating unit configured to heat a second surface of the medium, the second surface being opposite side of the first surface of the medium; wherein the first heating unit includes a first heating element and a second heating element adjacent to the first heating element, and the first heating element and the second heating element have a length, in a direction orthogonal to the transport direction, which is longer than a length in the transport direction, the second heating unit heats an area, the area superposing a gap between the first heating element and the second heating element, wherein the second heating element is adjacent to the first heating element in the direction orthogonal to the transport direction.

2. The drying apparatus according to claim 1, wherein the first heating element is detachable, from the first heating unit, separately from the second heating element.

3. The drying apparatus according to claim 1, wherein the first heating unit further includes a first reflective plate in which a first heating element is disposed and the second reflective plate in which a second heating element is disposed wherein the first hearing element and the first reflective plate are integrally movable relative to the second heating element.

4. The drying apparatus according to claim 3, wherein the first element and the first reflective plate are integrally detachable, from the drying apparatus, separately from the second heating element.

5. The drying apparatus according to claim 3, wherein the area heated by the second heating unit superposed a gap between the first reflective plate and the second reflective plate.

6. A printing apparatus comprising:

a transport unit configured to transport a medium in a transport direction, a printing unit configured to print on a first surface of the medium, a first heating unit configured to heat the first surface of the medium, the medium being printed and transported;

a second heating unit configured to heat a second surface of the medium, the second surface being opposite side of the first surface of the medium; wherein the first heating unit includes a first heating element and a second heating element adjacent to the first heating element, and the first heating element and the second heating element have a length, in a direction orthogonal to the transport direction, which is longer than a length in the transport direction, the second heating unit heats an area, the area superposing a gap between the first heating element and the second heating element, wherein the second heating element is adjacent to the first heating element in the direction orthogonal to the transport direction.

7. The printing apparatus according to claim 6, wherein the first heating element is detachable, from the first heating unit, separately from the second heating element.

8. The printing apparatus according to claim 6, wherein the first heating unit further includes a first reflective plate in which a first heating element is disposed and the second reflective plate in which a second heating element is disposed wherein the first hearing element and the first reflective plate are integrally movable relative to the second heating element.

9. The printing apparatus according to claim 8, wherein the first element and the first reflective plate are integrally detachable, from the drying apparatus, separately from the second heating element.

10. The printing apparatus according to claim 8, wherein the area heated by the second heating unit superposed a gap between the first reflective plate and the second reflective plate.

11. A drying apparatus comprising:

a first heating unit configured to heat a first surface of a medium, the medium being printed and transported in a transport direction;

a second heating unit configured to heat a second surface of the medium, the second surface being opposite side of the first surface of the medium; wherein the first heating unit includes a first heating element and a second heating element adjacent to the first heating element, and the first heating element and the second heating element have a length, in a direction orthogonal to the transport direction, which is longer than a length in the transport direction, the first heating element is removable from the first heating unit independently from the second heating element, the second heating unit heats an area, the area superposing a gap between a first end of the first heating element and a second end of the second heating element in the direction orthogonal to the transport direction.

* * * * *